United States Patent [19]

Haas et al.

[11] 4,137,566

[45] Jan. 30, 1979

[54] APPARATUS AND METHOD FOR ANALYZING A GOLF SWING AND DISPLAYING RESULTS

[75] Inventors: Steven L. Haas, Marion; Norman O. Fonteneau; Paul F. Sullivan, both of Acushnet; Hoyt C. Hottel, Jr.; Robert A. Brown, both of Mattapoisett; William Gobush, North Dartmouth; John W. Jepson, Marion; Francis deS. Lynch, Mattapoisett, all of Mass.

[73] Assignee: Acushnet Company, New Bedford, Mass.

[21] Appl. No.: 832,565

[22] Filed: Sep. 12, 1977

[51] Int. Cl.[2] ..... G06G 7/48; A63B 53/00

[52] U.S. Cl. ..... 364/410; 73/167; 273/186 C; 273/187 R; 364/515

[58] Field of Search ..... 364/410, 525, 518, 521; 273/186 R, 186 C, 183 R, 183 C, 183 D, 35 R, 193 R, 87.2, 87.4; 35/29 A; 250/336, 349, 351, 203 R, 549, 578, 216; 356/256; 73/167

[56] References Cited

U.S. PATENT DOCUMENTS

| | | | |
|---|---|---|---|
| 3,173,348 | 3/1965 | Betinis | 273/186 R |
| 3,353,282 | 11/1967 | Sneed | 273/186 R |
| 3,408,750 | 11/1968 | McCollough et al. | 35/29 A |
| 3,429,571 | 2/1969 | Abel, Jr. | 273/186 R |
| 3,630,601 | 12/1971 | LeBovee | 356/256 |
| 3,820,133 | 6/1974 | Adorney et al. | 35/29 A |
| 3,918,073 | 11/1975 | Henderson et al. | 273/186 R |
| 4,005,261 | 1/1977 | Sato et al. | 273/183 R |
| 4,063,259 | 12/1977 | Lynch et al. | 35/29 A |

OTHER PUBLICATIONS

Selcom Brochure Describing Electro-optic Sensor System.

DEC PDP-11 GT44 System Brochure Describing Computer Graphics System.

Sony Golf Clinic System Brochure.

*Primary Examiner*—Charles E. Atkinson

*Assistant Examiner*—Errol A. Krass

*Attorney, Agent, or Firm*—Eyre, Mann, Lucas & Just

[57] ABSTRACT

A measurement system obtains and stores digital data on the positions of golf club and significant human body parts during a golf club swing. An interactive display allows later display of the measured performance for use in instruction or review. A coordinate transformer allows the viewing of a displayed simulated golfer from any aspect and at variable speeds and stop action. A generator such as an alphanumeric or graphic generator displays suggested display options, graphics, informative labels, and alphanumeric tabular data. Permanent copies of any displayed picture can be made for later home study.

17 Claims, 1 Drawing Figure

APPARATUS AND METHOD FOR ANALYZING A GOLF SWING AND DISPLAYING RESULTS

SUMMARY OF THE INVENTION

The present invention relates to a teaching system for golfers. More specifically, it obtains measured data about the athlete's performance, analyzes the data and displays selected sequence of data under the control of the golfer or of an instructor.

The understanding of how aerodynamics affects the flight of golf balls has been greatly advanced. The applicants have disclosed in U.S. Pat. application Ser. No. 626,712 now U.S. Pat. No. 4,063,259 that the carry of a golf ball can be predicted when the characteristics of the golf ball and the launch conditions of launch angle, initial spin velocity, and initial velocity are known. The applicants have discovered that the golf ball carry of virtually any golfer can be improved by modification of one or more of the initial values of loft, spin or velocity. This modification has previously been done either by trial-and-error by the golfer himself or by observation and instruction by a golf pro or other instructor. The effectiveness of the instructor in this performance modification has been limited by the difficulty of obtaining sufficiently accurate information on such a complex whole-body physical act as a golf swing which is usually completed in less than two seconds. There are so many events happening so quickly that the instructor has difficulty getting adequate data for forming a corrective instructional approach. Once the instructor has developed a corrective instructional approach, he then lacks the facility to accurately refer back to details of the golfer's errors in pointing out the modifications to be made. Finally, the instructor lacks the means to compare new and old performance on a point-by-point basis.

The present invention acquires and stores data defining the positions of the golf club and the significant parts of the golfer's body at closely spaced points in time. The data are interpreted to prepare a quasi-continuous time history of the golf club and the golfer's body throughout the backswing, downswing and follow-through. The stored data are prepared in a form which can be displayed on a display device such as a cathode ray tube (CRT). One contemplated mode of data presentation displays a computer-generated graphic representation of a golfer, commonly called a stick figure, which goes through the same complex whole-body motion as the golfer. The stick-figure presentation can be exercised at variable speeds both forward and reverse and including stop-action. Repetitive presentations of the same swing, or any part thereof, can be performed to give the instructor time to explain the full significance of each subpart of the swing or to allow the golfer to make a self-analysis, either alone or with the aid of a programmed computer.

A coordinate transformation system allows the stick figure to be rotated so that the swing can be viewed from any horizontal or vertical angle. For example, front, back, left side, right side, overhead, 45 degrees downward view or any combination of horizontal and vertical angles. In addition, two or more angular views of the stick figure can be simultaneously displayed. For example, a right side view and an overhead view can be displayed side-by-side on the screen with the figure in both views going through the swing simultaneously or independently.

The data on the golfer's body and club motions are taken using an electro-optical system in which the significant joints of a golfer's body and points on the club are determined in three dimensions at closely spaced time intervals. When the joints are thus known in three dimensions, the positions of the rigid body parts connected between the joints are also known. For example, if the three-dimensional positions of the right shoulder and the right elbow are known, then the three-dimensional position of the upper arm connected between these joints is also known.

In one embodiment of the electro-optical system, light sources are connected on or near the significant body joints. It is presently contemplated that significant body joints consist of at least the hips, wrists, elbows, shoulders, knees and ankles. It may also be advantageous to monitor one or more points on the golfer's head. Some of the significant body joints may not require monitoring since their positions may not be necessary for a particular purpose or may be fixed by calculation. For example, in the latter case, if the geometric position of the golf club is known, the position of the golfer's wrists adjacent to the golf club grip can be calculated.

The light sources, which may be visible or infra-red light emitting diodes or other suitable sources, may be attached to appropriate locations on the golfer himself or on the clubs or on a garment or harness which the golfer dons before beginning the monitoring session. The light sources may be illuminated continuously, but the association of specific light source with specific body joint or golf club location is simplified if the light sources are pulsed on one at a time in fixed repetitive sequence. When an electro-optical sensor detects the energy from the light source in the time slot identified with, for example, the right elbow, the resulting data are assumed to be from the right elbow. If the light sources are illuminated continuously, the more difficult task of identifying each of several simultaneously sensed light sources must be performed. This identification may be done using tracking methods similar to radar tracking of multiple targets, or each light source may be individually tagged with an identifying characteristic such as color or pulse repetition frequency.

Passive methods may also be employed to mark the locations of joints. For example, retroreflective material, such as a trademarked material known as Scotchlite, manufactured by the 3M Company, may be affixed adjacent to the significant body joints in approximately the same locations selected for the active light sources. Retroreflective material has the property that it reflects incident light very preferentially back toward the source of the light. An apparent brightness enhancement of 900 times, as compared to a perfect Lambertian reflector is attainable using commercially available retroreflective material. In order to attain significant brightness enhancement, the illumination and viewing incidence angles must be nearly coincident. Thus each electro-optical sensor requires a light source associated with it. For best results the light source should be optically centered in the field of view of the electro-optical sensor but adequate results may be attainable with the light source positioned closely adjacent to the sensor. Passive retroreflective techniques do not offer easy methods of discriminating between a plurality of simultaneously visible retroreflective patches. Thus, joint discrimination must be performed in the manner described for unpulsed light sources.

One electro-optical sensor viewing a light source generates X and Y analog outputs capable of fixing the position of the light source in two angular dimensions. To fix the light source in three linear dimensions by triangulation requires two views of the source from different angles, preferably of at least 30 degrees between their lines of sight to the light source. The triangulation accuracy improves with increases in angle between lines of sight becoming best at about 90 degrees.

Due to the complex and changing posture of the golfer as he goes through the entire motions of backswing, downswing and follow-through, it is not usually possible to find two locations for electro-optical sensors which will provide unobscured line of sight to the light sources marking each significant body joint. For any sensor location chosen, some of the light sources may be hidden from it by body parts during some part of the motion. A two-sensor system can be made to work by calculating the positions of hidden joints from measurements of visible joints and known body dimensions but better results are obtained using more than two sensors in order that each light source is visible to at least two electro-optical sensors substantially all the time. However, substantially uninterrupted two-sensor viewing may require as many as eight electro-optical sensors. The applicants have discovered that four correctly placed electro-optical sensors are adequate for purposes of the present invention.

In accordance with the preferred embodiment of the present invention, the pulsed light sources are turned on and off one at a time in a fixed sequence by a sequence generator. The sequence generator may be on or off the golfer's body. Synchronizing information from the sequence generator must be available to the data collection device in order that the measured data will be correctly identified. In one embodiment, a sequence generator is off the golfer's body and is connected to the light sources on the golfer's body by a flexible cable. A wired synchronizing connection is provided between the sequence generator and the data collection device. Alternatively, the synchronizing data may be transmitted to the data collection device by radio or optical transmission. The data collection device can also obtain synchronizing data directly from the on-off pattern of the pulsed light sources themselves without auxiliary means of transmitting synchronizing data to it. For example, if 30 pulsed light sources are operated in sequence in 100 microsecond time slots, one channel of which is always sensed by at least one camera and is pulsed on for 55 microseconds in its time slot and with all other sources turned on for 50 microseconds in their respective time slots, the long pulse can be used as a framing signal to define that channel as channel 1 with 2–30 following in order.

The trailing flexible cable from the sequence generator to the light sources on the golfer's body can be eliminated by making the light sources battery powered and self contained on the golfer's body. In this case, sequence generation may be obtained from a battery powered sequence generator on the golfer's body or from an external sequence generator which communicates the sequence data to the apparatus on the golfer's body using radio or optical communication.

The muscular and skeletal characteristics of golfers differ. Consequently, not all golfers can play at competition levels. However, given the golfer's body makeup, the set of capabilities which he possesses can be utilized in a more effective manner to improve his game. The present invention is capable of determining the kinetic and kinematic parameters (e.g. velocities, displacements, forces, torques, and accelerations) actually developed by the golfer in his swing. This is done by analyzing the golfer's body and golf club as a compound pendulum system whose elements have known or determined lengths, masses and inertias. By determining the kinematic parameters actually produced by the golfer in his swing, the forces and torques which he has actually applied to the analytic compound pendulum may then be calculated if desired. A comparison may then be made of the golfer's actual performance and the performance of a model golfer. Side-by-side, overlay or other display methods may be used to show the golfer whatever modifications he should make in order to perform at his best. For example, if it is discovered that a model golfer having the golfer's physical attributes obtained a greater carry when he uncocked his wrists a few milliseconds later, this difference will show up in, for example, a side-by-side slow motion presentation of measured and model golfers. Similarly, the golfer's swing at a previous lesson can be compared to a swing at a later lesson to show him the progress or regression made.

An alphanumeric generator displays readable data on the CRT. The alphanumeric display material is of two types: operating instructions and results. The operating instructions consist of the words and numbers which inform the user about display options available and how to obtain them. For example, an operating instruction may consist of a tabular list of body views which may be selected. An interactive control, such as a light pen, joy stick, or keyboard can then be used to select one of the options or to request more information. The alphanumeric results display includes information tabs which label the display mode in use as well as running numbers such as time to impact, clubhead velocity and deviation from ideal.

A hard copy generator allows the golf instructor to reproduce any selected display on the CRT in permanent form. The instructor can thus prepare a set of study materials which the golfer can carry away with him for later review.

DETAILED DESCRIPTION OF THE PREFERRED EMBODIMENT

Figure 1A:
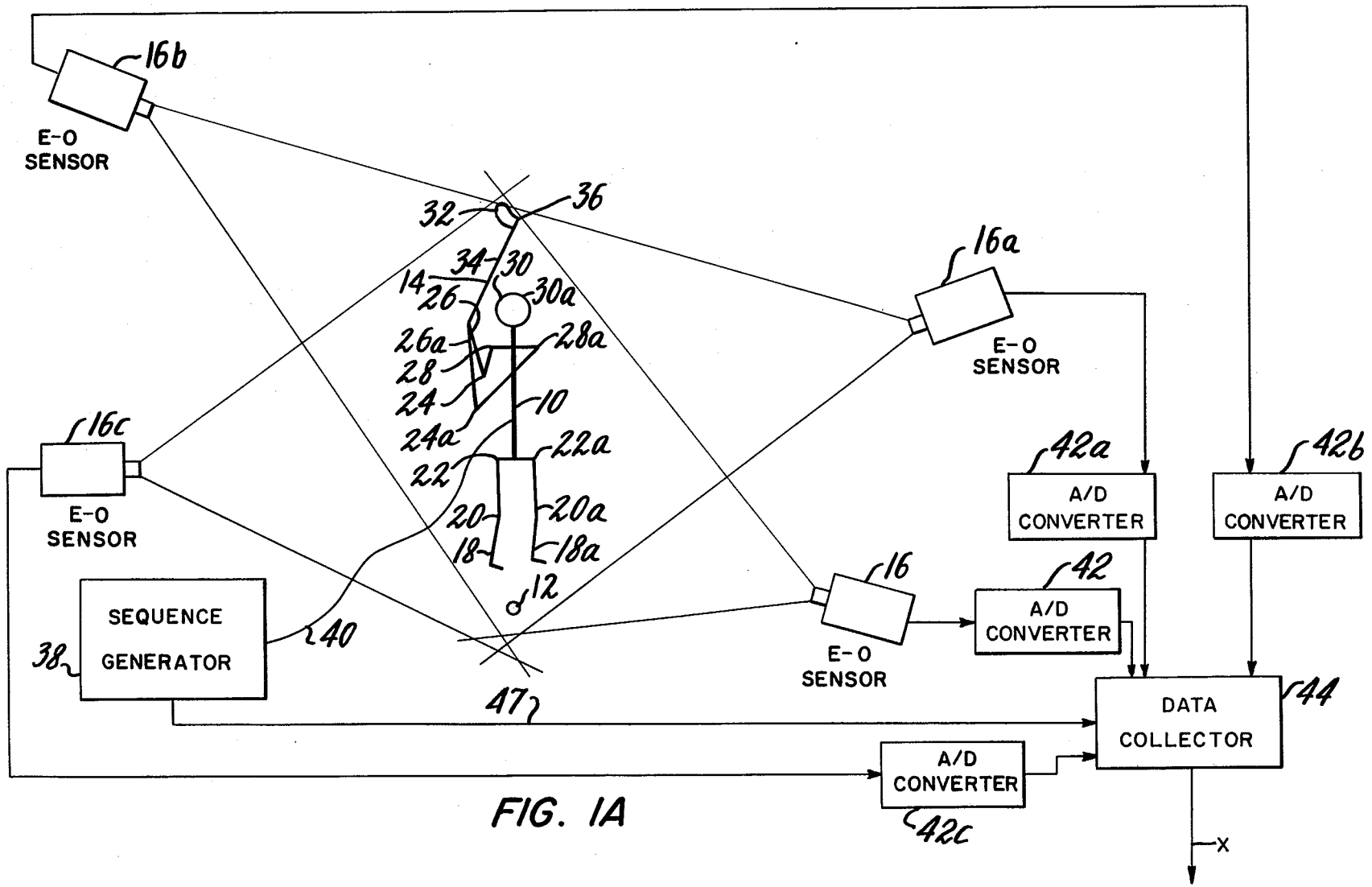
FIGS. 1A and 1B show a partially schematic block diagram of one embodiment of the invention.
Figure 1B:
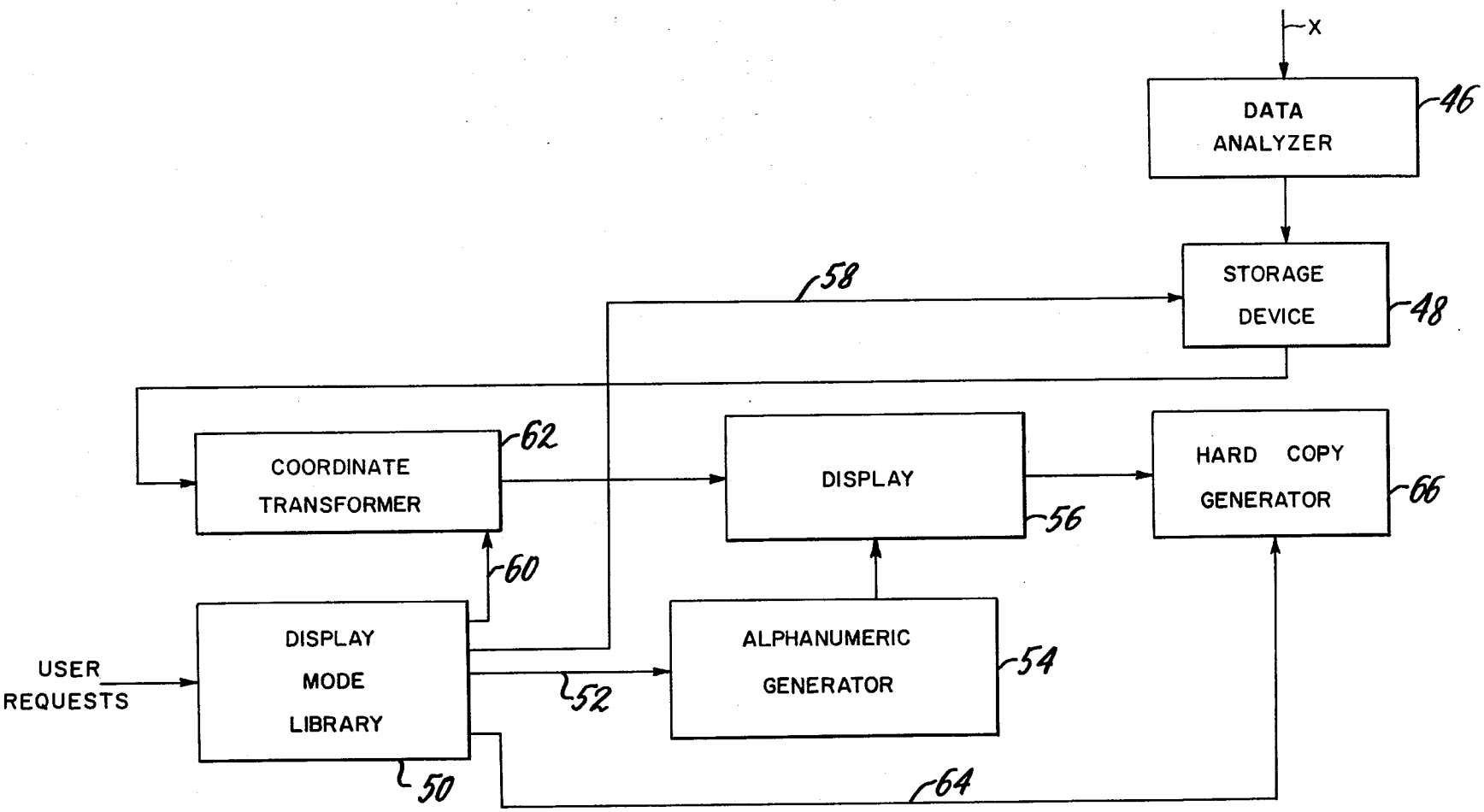

Referring to the figure, there is shown one embodiment of the system. A golfer 10 is positioned before a golf ball 12 in appropriate stance to hit it with a golf club 14 which he holds. The golfer 10 and golf club 14 are within the field of view of a plurality of electro-optical sensors 16, **16*a*, 16*b*, 16*c*. The fields of view of the electro-optical sensors 16, 16*a*, 16*b*, 16*c* are directed so that their lines of sight are preferably at least 30 degrees apart and the golfer 10 and golf club 14 are continuously encompassed within their fields of view during the entire motion associated with driving a golf ball. Although four electro-optical sensors 16, 16*a*, 16*b*, 16*c* are shown, a number of from 2 to 8 may be used. Four electro-optical sensors 16, 16*a*, 16*b*, 16*c*** is the preferred number since four give sufficient accuracy and measurement reliability without the additional cost and complexity resulting from a greater number of sensors.

The golfer 10 has a plurality of light sources 18, 18*a*, 20, 20*a*, 22, 22*a*, 24, 24*a*, 26, 26*a*, 28, 28*a*, 30, 30*a* affixed adjacent to significant joints in his body and on his head. In addition, the golf club preferably has at least three light sources at separated non-collinear positions, as for example, at the toe 32, heel 36 and shaft 34 of the club. There are instances where only one light source is required on the club, e.g. if there is no desire to measure the orientation of the clubhead. However, in order to obtain good data for shaft extrapolation, there are preferably at least two light sources even where orientation of the clubhead is not being measured. Timing signals for the sequential energization of all light sources are generated by a sequence generator 38. The electrical energization signals are connected from the sequence generator 38 to the light sources on the golfer 10 by a flexible cable 40.

It will be understood that it is also possible to use only one light source on the clubhead (or two on the shaft for extrapolation to the clubhead) to measure only the path of a point of the clubhead. This has been found to be in and of itself a very valuable teaching tool.

The analog outputs of each electro-optical sensor 16, 16*a*, 16*b*, 16*c* are converted to digital values in associated analog to digital (A/D) converters 42, 42*a*, 42*b*, 42*c* and connected to a data collector 44. A synchronizing signal 47 is connected to the data collector 44 from the sequence generator 38. As each light source is pulsed on, the synchronizing signal 47 allows the data collector 44 to label and store the data in the correct location for that particular light source. For example, if the light source associated with the golfer's left knee 20*a* is triggered on by signals from the sequence generator 38, the synchronizing signal 47 enables recognition by the data collector 44 that any signal occurring at that time originated in the light source associated with the golfer's left knee 20*a*.

During and after data collection, a data analyzer 46 constructs a time history of the golfer's body parts and stores the time history in memory in a storage device 48. The data in the storage device 48 may be time histories only or may also include other performance variables such as kinematic and kinetic parameters. Various methods for analyzing the collected data for coordinate transformation are well known to those of ordinary skill in the art and include hard wired devices, computers and the like.

A display mode library 50 provides the means for user selection of data display mode. Initially, a signal 52 to an alphanumeric generator 54 causes a menu of selectable options to be generated and displayed on a display 56. The user then selects, by appropriate input commands to the display mode library, what data he wishes to view, and in what orientation he wishes to view it. A command line 58 to the storage device 48 enables the readout of the specific data requested. A command line 60 to a coordinate transformer 62 causes the data to be rotated to the desired orientation before being displayed on the display 56.

At any time, the user can initiate a request to the display mode library 50 for a hard copy of the material then displayed on the display 56. A command line 64 to hard copy generator 66 enables the hard copy generator 66 to produce a copy of the displayed material.

It will be understood that the claims are intended to cover all changes and modifications of the preferred embodiments of the invention, herein chosen for the purpose of illustration which do not constitute departures from the spirit and scope of the invention.

What is claimed is:

1. Apparatus for analyzing a gold swing by a golfer holding a golf club comprising:

(a) at least first and second electro-optical sensors having different fields of view encompassing said golfer and golf club during at least a portion of said golf swing;

(b) optical means for marking at least some significant body locations on said golfer and said golf club;

(c) means for determining the three-dimensional location of at least some of said optically marked locations at selected time intervals;

(d) means for storing said three-dimensional locations;

(e) means for displaying a time history of at least some of said stored three-dimensional locations; and (f) said at least first and second electro-optical sensors having sensing axes located at least 30 degrees apart.

2. The apparatus recited in claim 1 wherein said optical means for marking comprises:

(a) a plurality of radiation sources affixed adjacent to said significant body locations; and (b) means for sequentially pulsing each of said radiation sources into operation.

3. The apparatus recited in claim 2 wherein said means for determining the three-dimensional location comprises:

(a) means for converting analog outputs of said electro-optical sensors into mathematical values; and (b) means for calculating the three-dimensional location of each of said radiation sources which is simultaneously visible to at least two electro-optical sensors, said calculating being based on said mathematical values.

4. The apparatus recited in claim 1, wherein said means for displaying comprises:

(a) means for analyzing said measured body locations and generating therefrom data representing a time history of the locations of at least some significant body segments;

(b) a display; and (c) means for presenting said time history of the locations of significant body segments on said display.

5. The apparatus recited in claim 4 further comprising means for rotating coordinates of said body segments.

6. The apparatus recited in claim 4 further comprising means for selecting predetermined modes of displaying said time history of locations.

7. The apparatus recited in claim 4 further comprising means for generating alphanumeric data for display on said display.

8. The apparatus recited in claim 4 further comprising means for generating permanent copies of selected images displayed on said display.

9. Apparatus for analyzing a golf swing by a golfer holding a golf club comprising:

(a) means for marking at least some significant body locations on said golfer and golf club;

(b) at least a first and second means for sensing the positions of each of said marking means at a plurality of times, said first and second means for sensing having respective sensing axes;

(c) the sensing axes of said first and second sensors being at least 30 degrees apart;

(d) triangulation means for calculating the three-dimensional location of at least some of said means for marking which are sensed by at least two of said sensors;

(e) means for storing said three-dimensional locations for at least a subset of said plurality of times;

(f) means for analyzing a subset of body and golf club three-dimensional locations as a connected subset of body and golf club segments; and (g) means for displaying said interpreted connected subset of body and golf club segments.

10. The apparatus recited in claim 9, wherein said significant locations comprise:

(a) ankles;

(b) knees;

(c) hips;

(d) shoulders;

(e) elbows;

(f) wrists; and (g) at least one point on said golf club.

11. The apparatus recited in claim 9, wherein at least one element of said electro-optical means comprises a large-area silicon target detector.

12. The apparatus recited in claim 9, wherein said means for displaying comprises a cathode ray tube display.

13. The apparatus recited in claim 12, further comprising alphanumeric generator means for presenting alphanumeric data on said cathode ray tube.

14. The apparatus recited in claim 9, further comprising means for rotating the coordinates of said body and golf club segments before display thereof.

15. The apparatus recited in claim 9 further comprising:

(a) means for analysis of the forces and torques applied by said golfer to at least some of said body and golf club segments, said analysis being based on said sensed positions;

(b) means for predicting the flight performance of a golf ball struck by said golfer using the forces and torques applied; and (c) means for analytically varying said golfer's swing using said analyzed forces and torques.

16. The apparatus recited in claim 15 further comprising:

(a) stored data representing the performance of an ideal golfer;

(b) means for employing said forces and torques generated by said golfer in calculating the performance of said ideal golfer; and (c) said means for displaying including means for presenting a comparison of the swing and ball flight performance of said golfer and said ideal golfer.

17. Apparatus for analyzing a golf swing by a golfer holding a golf club comprising:

(a) pulsable light sources affixed to significant locations on said golfer's body and to said golf club;

(b) at least two electro-optical sensors having their optical axes spaced at least 30 degrees apart;

(c) said electro-optical sensors being responsive to energization of said light sources to provide signal outputs indicating the location of said light sources;

(d) triangulation means for determining, at a plurality of times, the three-dimensional location of energized light sources which are simultaneously visible to at least two electro-optical sensors;

(e) means for storing at least a subset of said three-dimensional locations;

(f) means for interpreting said subset of three-dimensional locations as a connected subset of body and golf club segments; and (g) cathode ray tube display means for displaying said connected subset of body and golf club segments.

* * * * *